US005600083A

United States Patent [19]

Bentley et al.

[11] Patent Number: 5,600,083

[45] Date of Patent: Feb. 4, 1997

[54] MAGAZINE FOR PUMP ACTION SHOTGUN

[76] Inventors: James K. Bentley, 2489 Starling Dr., Paso Robles, Calif. 93446; Willard H. Crawford, 1836 Orange St., Bakersfield, Calif. 93004

[21] Appl. No.: 453,867

[22] Filed: May 30, 1995

Related U.S. Application Data

[63] Continuation-in-part of Ser. No. 343,332, Nov. 21, 1994, Pat. No. 5,456,153.

[51] Int. Cl.[6] ..... F41A 9/74

[52] U.S. Cl. ..... 89/33.02; 89/34; 89/33.17; 42/49.01

[58] Field of Search ..... 89/34, 33.02, 33.17; 42/49.01, 49.02, 50

[56] References Cited

U.S. PATENT DOCUMENTS

| | | | |
|---|---|---|---|
| 198,368 | 12/1877 | Farrington | 89/34 |
| 2,011,889 | 8/1935 | Birkigt | 89/34 |
| 2,375,453 | 5/1945 | Webb | 89/33.02 |
| 3,032,907 | 5/1962 | Parker | 89/34 |
| 4,138,923 | 2/1979 | Broggeau et al. | 89/33.02 |
| 4,658,700 | 4/1987 | Sullivan | 89/33.02 |

FOREIGN PATENT DOCUMENTS

| | | | |
|---|---|---|---|
| 496950 | 11/1919 | France | 89/33.02 |

*Primary Examiner*—Stephen M. Johnson
*Attorney, Agent, or Firm*—Charles C. Logan, II

[57] ABSTRACT

A magazine filled with ammunition that can be quickly and easily attached to and detached from a firearm. It has a snail-shaped housing with a laterally offset chimney section that has an outlet port at its top end for feeding the ammunition into the firearm. The magazine is capable of being attached to the firearm at two 180 degree separated positions to accommodate a left or right handed person. There is an annular chamber in the housing of the magazine and it contains a spring-loaded drum. A pair of laterally spaced cog gears are mounted on the drum for capturing ammunition shells and transporting them along a circular axis until they reach the vertical linear axis of the chimney section. A follower assembly pushes the ammunition shells up through the chimney section. A shell retainer unit is mounted in the chimney section for preventing shells from exiting its outlet port when the magazine is detached from the firearm. The shell retainer unit is deactivated by a depressor member that moves downwardly when the magazine is attached to the firearm.

3 Claims, 3 Drawing Sheets

MAGAZINE FOR PUMP ACTION SHOTGUN

This application is a continuation-in-part of prior U.S. application Ser. No. 08/343,332 filed Nov. 21, 1994 now U.S. Pat. No. 5,456,153.

BACKGROUND OF THE INVENTION

The invention relates to pump action shotguns and more specifically to a magazine to be loaded with shotgun shells.

Presently pump action shotguns have structure which restricts the number of shotgun shells that can be loaded in its magazine tube to five shells. When all five shells have been fired, it is necessary to turn the shotgun over and physically load one shell at a time into the magazine tube. This is an unreasonable delay when the weapon is in the hands of a military person in a life threatening situation. The same problem would exist for police officers or swat team members that use the pump action shotgun. The prolonged period for reloading the shotgun also affects skeet shooters when competing in competitions.

Recently the inventor has been able to modify a conventional pump action shotgun so that it will function with a magazine loaded with shotgun shells. This magazine will presently hold ten shotgun shells.

It is an object of the invention to provide a novel magazine for a pump action shotgun that can be quickly and easily attached and removed from the shotgun.

It is also an object of the invention to provide a novel magazine for a pump action shotgun that can be installed in one orientation for left handers and installed in another orientation for right handers and which in either orientation accepts the shotgun shells with their rear rim adjacent the back wall of the magazine.

It is another object of the invention to provide a novel magazine for a pump action shotgun that would be economical to manufacture and market.

It is a further object of the invention to provide a novel magazine for a shotgun that can be attached to the shotgun using one hand or removed from the shotgun using one hand.

It is also an object of the invention to provide a novel magazine for a shotgun that allows the shotgun to be laid flat on its side when the magazine is attached thereto.

It is an additional object of the invention to provide a novel rotary magazine for a firearm that self-charges its spring-loaded follower assembly as the magazine is being loaded with shells.

It is another object of the invention to provide a novel rotary magazine for a shotgun that is relatively compact and, not difficult to reach around when actuating the forearm of a pump action shotgun.

It is also an object of the invention to provide a novel magazine for a shotgun that accepts shotgun shells having different lengths.

It is another object of the invention to provide a novel rotary magazine for a shotgun that has grooves adjacent the front and rear end of the shotgun shells.

It is a further object of the invention to provide a novel rotary magazine for a shotgun that has novel structure that allows the front ends of the shotgun shells to travel around the interior of the magazine in a cantilevered manner without requiring any support for the shotgun shells adjacent their front ends.

SUMMARY OF THE INVENTION

The invention relates to a novel magazine that can be used with a modified pump action shotgun. The inventor's novel structure for a magazine loaded pump action shotgun can be incorporated into existing pump action shotguns by doing minimal modification of existing structure or by use of a retrofit kit. The novel structure can also be incorporated into new pump action shotguns so that they would be originally manufactured with a quickly attachable and detachable shotgun shell magazine.

The modification of an existing pump action shotgun will now be described. This shotgun will normally be retro-fit with a new forearm, a new magazine tube, a new subgroup assembly and a magazine. The elongated coil magazine spring would be removed from the magazine tube. A shotgun shell loading port would be formed in the bottom surface of the magazine tube adjacent the front end of the receiver. A magazine adapter would be welded on the bottom surface of the magazine tube and it would surround the shotgun shell loading port. The top surface of the magazine tube would also have a longitudinally extending slot formed in its top surface. The forearm would have a transversely extending bore hole drilled in its top surface adjacent its forward end. An allen screw would be inserted through this bore hole, through the longitudinal slot in the top surface of the magazine tube and screwed into an internally threaded bore hole in the cylindrical head member of the compressible subgroup assembly that would be inserted into the interior of the magazine tube. Thus the reciprocal pump action of the forearm would cause the compressible subassembly to travel rearwardly with the forearm as a single unit and the allen screw would pass along the length of the slot in the top surface of the magazine tube. The bottom surface of the forearm would also have to be relieved so that the forearm can pass the magazine adapter that has been welded onto the bottom surface of the magazine tube. It should be noted that there is no modification to the receiver. Therefore, if so desired, all the modified parts can be removed and the shotgun can be returned to its original condition.

The novel magazine has a snail-like shape that is formed by a substantially circular drum shaped housing with a laterally offset chimney section. A tubular drum has its opposite ends journaled with respect to the inner surfaces of the front and rear walls of the housing. An annular chamber is formed in the housing with its inner surface being defined by the outside surface of the tubular drum. The remainder of the annular chamber is formed by the respective front wall, rear wall, top wall, bottom wall, left side wall and right side wall of the housing. The annular chamber has a circular axis. The chimney section has a linear chamber having an outlet port at its top and an inlet port at its bottom end. The linear axis of the chimney section substantially intersects the circular axis tangentially. By having the circular portion of the housing offset from the chimney section, the shotgun can be laid flat on its side while the magazine is secured thereto. Also by having the chimney section laterally offset, the action of the person shooting the shotgun when he pulls the forearm rearwardly allows his hand to avoid colliding with the circular portion of the magazine.

Also since the top end of the chimney section has vertical grooves adjacent both its front and rear walls for receiving the brass flange on a the shotgun shell, the shells can be loaded into the magazine from 180 degree opposite orientations. The respective vertical grooves in the chimney section mate with annular grooves in the circular drum shaped housing so that the brass flange on the shotgun shells is positively captured as they travel along their entire circular path in the circular drum shaped housing and also their linear path up through the chimney section. This eliminates the need to provide any type of support for the front ends of the shells. The total groove system positively captures the brass flanges of the shotgun shells and keeps them from jamming when the shotgun is rapidly fired. The structure that positively captures the rear ends of the shotgun shells allows shotgun shells of different lengths to be used in the magazine. These shotgun shells of different lengths do not require any support structure for the front ends of the shotgun shells. The longitudinal axes of the shotgun shells remain substantially horizontal and parallel to each other as they travel through the magazine. The novel groove system allows the magazine to be attached to the shotgun in either of two different orientations that are 180 degrees opposite each other and allows a single magazine to be used for both left handers and right handers.

The magazine has structure for spring loading its follower assembly that forces the shotgun shells around the circular axis of the annular chamber and up through the chimney section into the shotgun. The spring loaded structure self-charges itself as the shotgun shells are loaded into the magazine.

An elevator arm has its bottom end pivotally connected to the tubular drum inside the magazine housing. The front end of the elevator arm is secured to the rear end of the follower assembly which is pushing the shotgun shells out of the magazine. The elevator arm along with the articulated carriage of the follower assembly allows the last shells in the magazine to be first carried along a circular axis and then directed upwardly along a vertical linear axis all of the way to the outlet port of the chimney section.

The magazine also has a shell retainer unit mounted in the chimney section for preventing shells from exiting the outlet port of the chimney section when the magazine is detached from a firearm. The shell retainer unit has a spring-loaded lip that is biased to block the outlet of the chimney section when the magazine is not attached to a firearm. The spring loaded feed lip is mounted on the top end of a depressor member. The depressor member is moved downwardly when the magazine is attached to a firearm and this causes the feed lip to be withdrawn from the outlet port of the chimney section and this allows the shells to exit the outlet port and into the firearm where they are fired.

The unique structure at the top end of the chimney section and the mating structure of the magazine adapter allow the magazine to be changed by the firearm operator by the use of only one hand. The magazine can be quickly and easily attached and detached from the shotgun.

DESCRIPTION OF THE PREFERRED EMBODIMENT

Figures 1, 2, 3, 4:
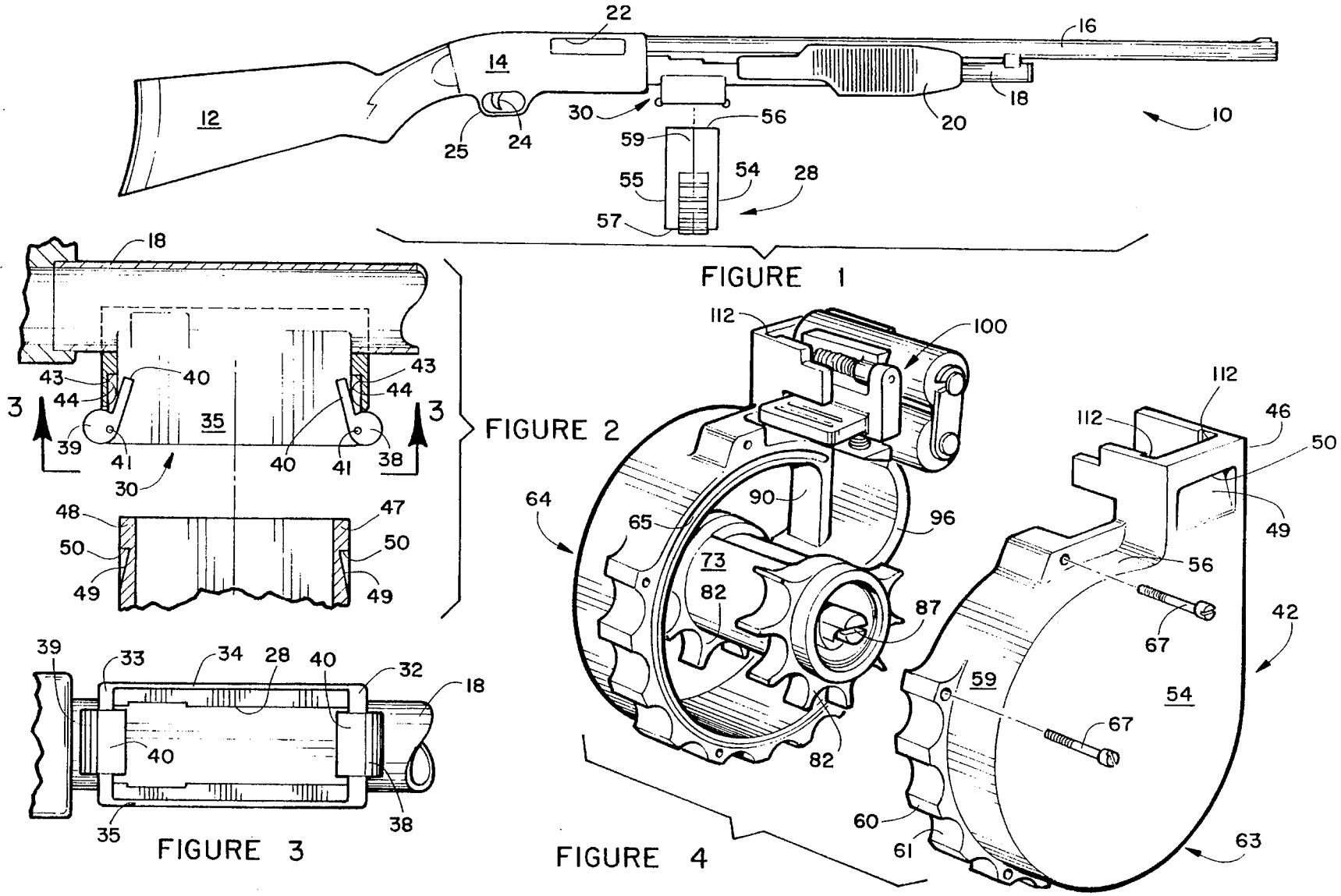
FIG. 1 is a side elevation view of a magazine loaded pump action shotgun.
FIG. 2 is an partial cross sectional view showing the manner in which the magazine adaptor engages the top end of the magazine and how it is secured to the shotgun.
FIG. 3 is a bottom plan view of the magazine adapter.
FIG. 4 is an exploded front elevation view of the novel magazine.

The novel magazine for a pump action shotgun will now be described by referring to FIGS. 1–10 of the drawings. The magazine loaded pump action shotgun is generally designated numeral 10.

Pump action shotgun 10 has a stock 12, a receiver 14, a gun barrel 16, a magazine tube 18 and a forearm 20. Receiver 14 has an ejection port 22, a trigger 24 and a trigger guard 25.

Pump action shotgun 10 has been modified in the manner illustrated. When modifying the existing pump action shotgun, most of the structure remains in tact. A shotgun shell loading port 28 is formed in the bottom surface of magazine tube 18. A magazine adapter 30 is then welded to the bottom surface of magazine tube 18. Magazine adapter 30 has a front wall 32, a rear wall 33, and laterally spaced side walls 34 and 35. A front latch member 38 and a rear latch member 39 on the magazine adapter 30 allow the shotgun shell magazine 42 to be quickly and easily attached and removed. The manner in which this is accomplished will be described by referring to FIGS. 2–4. Latch members 38 and 39 each have a finger 40 and they are rotatably mounted on pins 41. A recess 43 is formed on the inner surface of front wall 32 and rear wall 33 and they each have a spring 44 biasing fingers 40 inwardly. Shotgun shell magazine 42 has a chimney section 46 having a front wall 47 and a rear wall 48. Each of these walls has a recess 49 formed in their outer surface with a shoulder 50. When chimney section 46 is inserted into magazine adapter 30, the respective fingers 40 are depressed into recesses 43 until they are allowed to expand into the respective recesses 49 in chimney section 46. Once that occurs, shoulders 50 prevent the shotgun shell magazine 42 from inadvertently being removed. To remove the shotgun shell magazine, the fingers on one hand are slid downwardly across the respective outer surfaces of latch 38 and 39 causing them to rotate inwardly into their respective recesses 43 and chimney section 46 can be withdrawn from magazine adapter 30.

Shotgun shell magazine 42 will now be described by referring to FIGS. 1, 4, 5, and 6. Shotgun shell magazine 42 has a front wall 54, a rear wall 55, a top wall 56, a bottom wall 57, a left side wall 58 and a right side wall 59. Finger gripping ridges 60 separated by concave recesses 61 are formed on the outer surface of the housing of shotgun shell magazine 42. The housing is preferably formed from molded plastic and it has a front half 63 and a rear half 64. Rear half 64 has a groove 65 extending around most of its periphery that matingly receives a ridge or tongue extending outwardly from the rear surface of front half 63. Screws 67 secure the two halves together.

The inner structure of front half 63 and rear half 64 are substantially the same but reversed in their orientation. A recess 69 is formed on the inner surface of each of the respective front and rear walls 54 and 55 and they receive the opposite ends of rod 70. The inner surfaces of these respective walls each have an inwardly extending boss 72 that fits into the opposite ends of tubular drum 73 which is journaled thereon for rotational travel. An annular chamber 74 having a circular axis 75 is formed between the outer surface of tubular drum 73 and the inner surface of front wall 54, rear wall 55, top wall 56, bottom wall 57, left side wall 58 and right side wall 59. Chimney section 46 has a linear axis 77 that tangentially intersects circular axis 75. Chimney section 46 has an inlet port 78, a linear chamber 79, and an outlet port 80.

Tubular drum 73 has a pair of laterally spaced cog gears 82 formed on its outer surface whose structure functions to capture shotgun shells 84 so that they can be carried along annular chamber 74 toward inlet port 78 of chimney section 46 as drum 73 rotates. Tubular drum 73 is spring loaded to rotate with respect to the front and rear walls of the housing. A flat coiled spring 6 has its rear end rigidly engaged in the longitudinally extending slot 87 of rod 70. The front end of spring 86 is rigidly engaged in the transversely extending notch 88 on the inner surface of tubular drum 73. When shotgun shell magazine 42 is loaded, shotgun shells 84 are continuously inserted into chimney section 46 and as the shells engage cog gears 82, tubular drum 73 is caused to rotate until the rear end of shell ammunition follower assembly 89 rotates into contact with a stop limit wall 90 that extends into annular chamber 74. This limits the rotational travel of tubular drum 73 to less than 360 degrees.

Shell ammunition follower assembly 89 is in the form of an articulated carriage 92 having a pair of laterally spaced rollers 93 and 94 secured together by a connecting member 95. An elevator arm 96 has its front end connected to roller 94 and its rear end connected by a pivot pin 97 to tubular drum 73. Elevator arm 96 has a curved inner surface that mates with a recess 98 formed in the outer surface of tubular drum 73. Elevator arm 96 pushes shell ammunition follower assembly 89 along a rotational path through the annular chamber 74 and then lifts the shell ammunition follower assembly 89 along a vertical linear path through the linearly extending chamber 79 of chimney section 42 to its outlet port 80.

Figure 6:
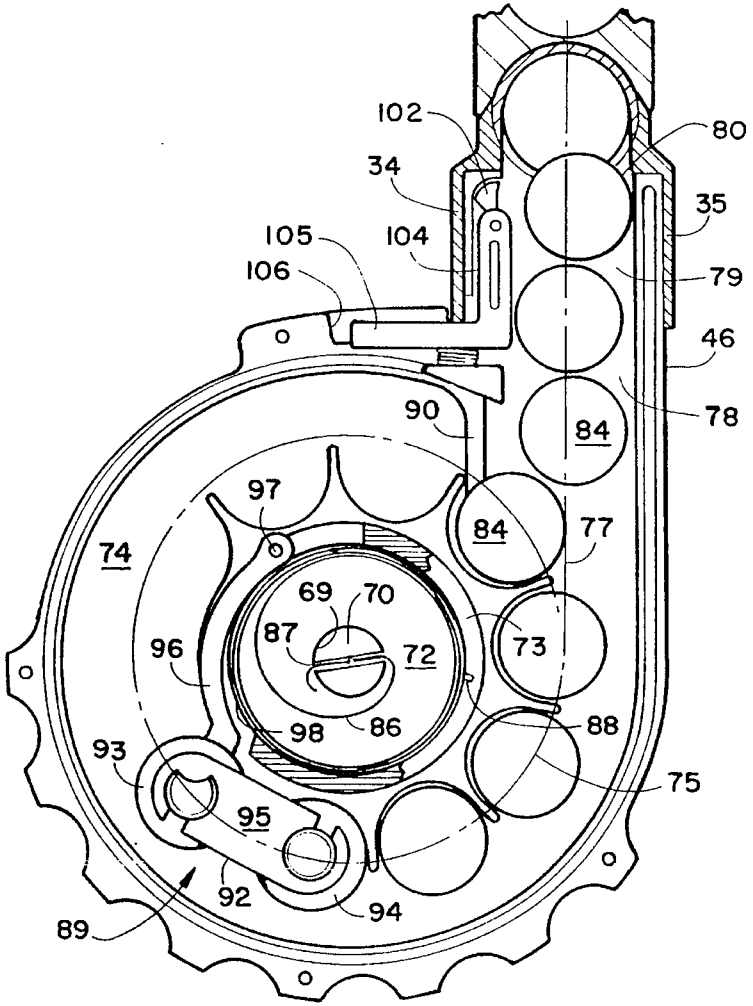
FIG. 6 is a side elevation view of one of the halves of the magazine showing the magazine partially loaded with shotgun shells and secured to the bottom end of the magazine adapter.
Figure 5:
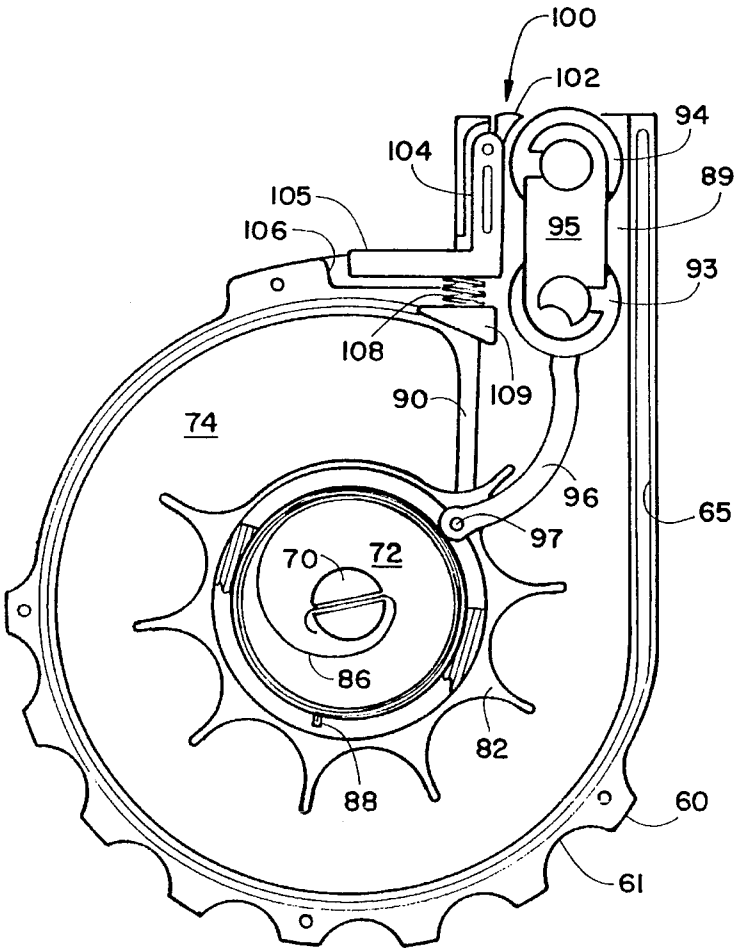
FIG. 5 is a side elevation view of the interior of one of the halves of the magazine showing it without shotgun shells loaded in it.
Figure 10:
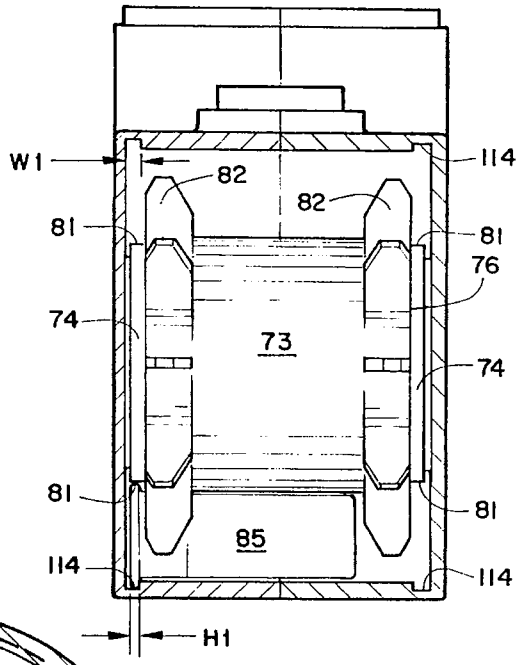
FIG. 10 is a vertical cross sectional view taken along lines 10—10 of FIG. 7.
Figure 9:
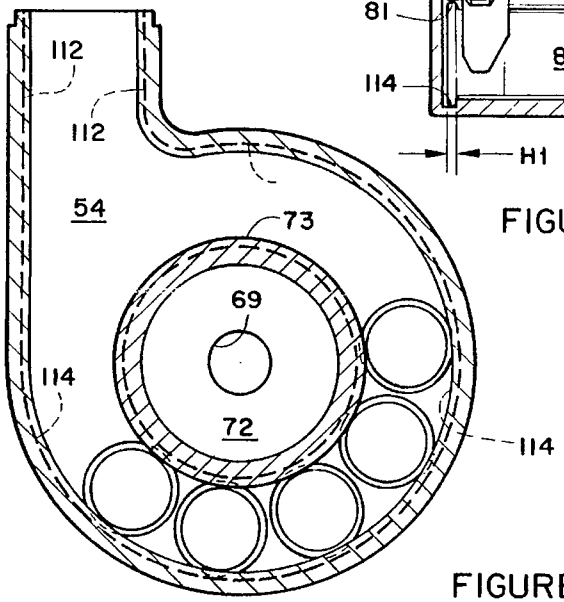
FIG. 9 is a cross sectional view taken along lines 9—9 of FIG. 7.
Figure 7:
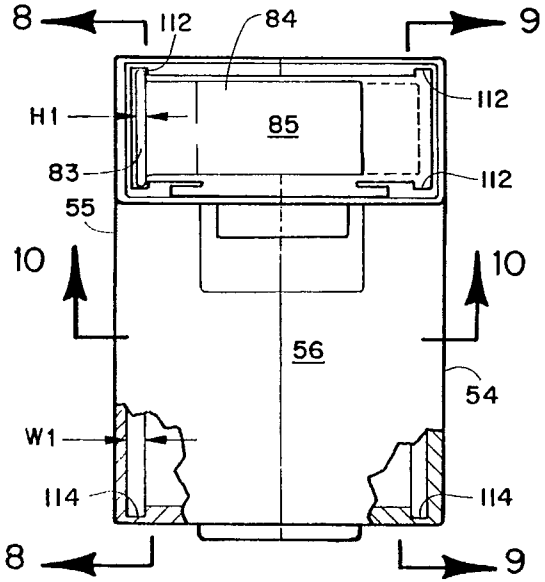
FIG. 7 is a top plan view of the magazine with portions broken away.
Figure 8:
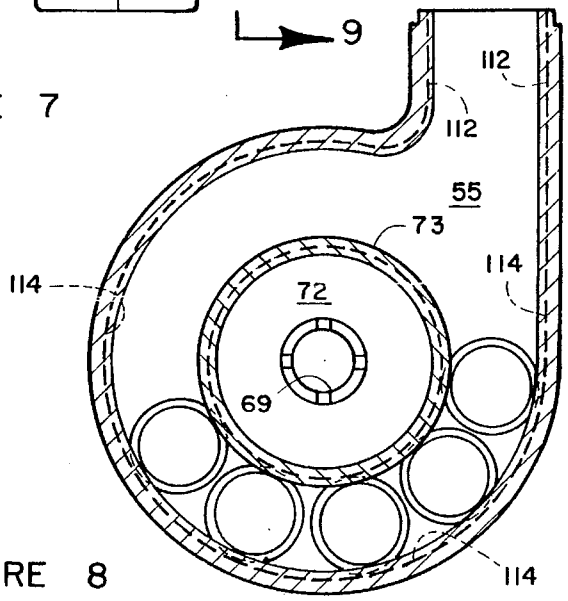
FIG. 8 is a cross sectional view taken along lines 8—8 of FIG. 7.

The shotgun shell magazine 42 has a shell retainer unit 100 mounted in chimney section 46 for preventing shotgun shells 84 from exiting outlet port 80 when the magazine is detached from the shotgun. Shell retainer unit 100 has a spring loaded retainer lip 102 that is biased to block the outlet port 80 of the chimney section 46 when the magazine is not attached to a firearm. Spring loaded retainer lip 102 is mounted on the top end of L-shaped depressor member 104. A horizontal leg 105 extends transversely from depressor member 104 and it is aligned with a recess 106 formed in top wall 56 of shotgun shell magazine 42. Springs 108 mounted on wedge 109 keep horizontal leg 105 in its upper position such as illustrated in FIG. 5. When chimney section 46 of the shotgun shell magazine is inserted into the bottom end of magazine adapter 30, the bottom edges of one of the side walls 34 or 35 will force horizontal leg 105 of the depressor member downwardly, as seen in FIG. 6. This causes feed retainer lip 102 to be withdrawn from the outlet port 80 and allows the shotgun shells 84 to pass through outlet port 80 and into the shotgun where they may be fired.

Vertical grooves 112 are formed on the inner surfaces of the side walls of chimney section 46 adjacent both its front wall and its rear wall. The width of the grooves 112 is slightly larger than the width of the flange on the brass sleeve located on the end of a shotgun shell. This allows the shells to be placed into the shotgun shell magazine 42 at orientations that are 180 degrees apart. This allows the shotgun shell magazine 42 to be attached to shotgun 10 in 180 degree reversed positions that would be more suitable for a right handed person or a left handed person. Vertical grooves 112 also positively capture the flanges on the shotgun shells and allow different length shells to be used. The vertical grooves eliminates the need to have vertical tracks on the inside wall of chimney section 46 to keep the shells from jamming.

FIGS. 7–10 show how the bottom ends of the grooves 112 of the chimney section 46 align with the grooves 114 of the circular drum shaped housing. The shotgun shells 84 have a body portion 85 and a flange 83 that travels in the respective grooves 112 and 114. Flanges 83 also ride against the outer surface of the opposite ends of tubular drum 73. These opposite ends of tubular drum 73 have reduced diameter neck portions 74 that along with shoulders 76 and the inner surfaces of the respective front and rear walls 54 and 55 form annular inner grooves 81 that capture the flanges 83 of the shotgun shells 84.

What is claimed is:

1. A magazine for a firearm comprising:

a housing having a front wall, a rear wall, a top wall, a bottom wall, a left side wall and a right side wall;

said front wall having an inner surface and said rear wall having an inner surface; a tubular drum having an outer surface also has opposite ends that are journaled in said respective inner surfaces; an annular chamber is formed in said housing with the inner surface being defined by the outer surface of said tubular drum and the outer surface of said annular chamber being defined by said top wall, said bottom wall, said left side wall and said right side wall;

said housing having a substantially vertical tubular chimney section having a top end, a bottom end, a left side wall, a right side wall, a front wall and a rear wall; an outlet port is formed in the top end of said chimney section and an inlet port is formed in the bottom end of said chimney section; said tubular chimney section having a linearly extending chamber and its bottom end is in communication with said annular chamber;

means for spring loading said drum so that the drum will rotate with respect to the front and rear walls of said housing;

means on the outer surface of said tubular drum for capturing (ammunition) shotgun shells so that they can be carried along said annular chamber toward the inlet port of said chimney section as said drum rotates;

a shell ammunition follower assembly having a front end and a rear end, said shell ammunition follower assembly travels immediately behind a last round of ammunition and pushes it forwardly toward the outlet port of said chimney section of said magazine;

means for connecting the rear end of said shell ammunition follower assembly to said rotating drum; and first means for capturing the flange on the brass sleeve located on the end of a shotgun shell and said first means is formed on the inner surfaces of the left and right side walls of said chimney section adjacent (its) the rear wall of said chimney section.

2. A magazine for a firearm comprising:

a housing having a front wall, a rear wall, a top wall, a bottom wall, a left side wall and a right side wall;

said front wall having an inner surface and said rear wall having an inner surface; a tubular drum having an outer surface also has front and rear ends that are journaled in said respective inner surfaces; an annular chamber is formed in said housing with the inner surface being defined by the outer surface of said tubular drum and the outer surface of said annular chamber being defined by said top wall, said bottom wall, said left side wall and said right side wall;

said housing having a substantially vertical tubular chimney section having a top end, a bottom end, a left side wall, a right side wall, a front wall and a rear wall; an outlet port is formed in the top end of said chimney section and an inlet port is formed in the bottom end of said chimney section; said tubular chimney section having a linearly extending chamber and its bottom end is in communication with said annular chamber;

means for spring loading said drum so that the drum will rotate with respect to the front and rear walls of said housing;

means on the outer surface of said tubular drum for capturing shotgun shells so that they can be carried along said annular chamber toward the inlet port of said chimney section as said drum rotates;

a shell ammunition follower assembly having a front end and a rear end, said shell ammunition follower assembly travels immediately behind a last round of ammunition and pushes it forwardly toward the outlet port of said chimney section of said magazine;

means for connecting the rear end of said shell ammunition follower assembly to said rotating drum;

first means for capturing the flange on the brass sleeve located on the end of a shotgun shell and said first means is formed on the inner surfaces of the left and right side walls of said chimney section adjacent the rear wall of said chimney section; and second means for capturing the flange on the brass sleeve located on the end of a shotgun shell; and said second means is formed on the inner surface of said housing adjacent its rear wall; a third means for capturing the flange on the brass sleeve located on the end of a shotgun shell and said third means is formed adjacent the rear end of said drum.

3. A magazine for a firearm as recited in claim 2 further comprising:

fourth means for capturing the flange on the brass sleeve located on the end of a shotgun shell and said fourth means is formed on the inner surfaces of the left and right side walls of said chimney section adjacent the front wall of said chimney section;

fifth means for capturing the flange on the brass sleeve located on the end of a shotgun shell; said fifth means is formed on the inner surface of said housing adjacent its front wall; sixth means for capturing the flange on the brass sleeve located on the end of a shotgun shell and said sixth means is formed adjacent the front end of said drum; and said fourth, fifth, and sixth means thereby allow shotgun shells to be placed into said magazine at an orientation that is 180 degrees reversed from the orientation of the shotgun shells when said first, second and third means are used for capturing the flange on the brass sleeve located on the end of a shotgun shell.

* * * * *